United States Patent [19]

McGrath et al.

[11] Patent Number: 4,696,471

[45] Date of Patent: Sep. 29, 1987

[54] TENNIS PRACTICE AID

[76] Inventors: Ann M. McGrath; James A. Douglas, both of 15507 La Madre Selva, P.O. Box 1995, Rancho Santa Fe, Calif. 92067

[21] Appl. No.: 860,629

[22] Filed: May 7, 1986

[51] Int. Cl.[4] ..... A63B 61/00

[52] U.S. Cl. ..... 273/29 A; 273/29 B

[58] Field of Search ..... 273/29 A, 29 R, 181 A, 273/30, 85 R, 400, 411, 401, 402, 407, 29 B

[56] References Cited

U.S. PATENT DOCUMENTS

| | | | |
|---|---|---|---|
| 755,936 | 3/1904 | Ricau | 273/30 |
| 3,082,005 | 3/1986 | Kron | 273/181 |
| 3,215,432 | 11/1965 | Lee et al. | 273/29 |
| 3,993,306 | 11/1976 | Scott | 273/29 |
| 4,092,023 | 5/1978 | Hazen | 273/26 A |
| 4,160,549 | 7/1979 | Simpson | 273/29 |
| 4,231,572 | 11/1980 | Thornton | 273/29 |
| 4,295,648 | 10/1981 | Stromback | 273/26 A |

FOREIGN PATENT DOCUMENTS

| | | | |
|---|---|---|---|
| 4995 | of 1902 | United Kingdom | 273/30 |
| 2516 | of 1902 | United Kingdom | 273/30 |
| 204863 | 9/1923 | United Kingdom | 273/30 |

*Primary Examiner*—Richard C. Pinkham
*Assistant Examiner*—T. Brown
*Attorney, Agent, or Firm*—Loyal M. Hanson

[57] ABSTRACT

A device is disclosed for mounting on an installed tennis net as a target. The device employs a target member defining a silhouette having a size generally on the order of a conventional tennis ball. A mounting member adapted to be removably secured to a conventional tennis net headband by engagement of just the headband serves as a mounting for the target member. The target member is connected to the mounting member so that the target member is supported slightly above a headband to which the mounting member is secured.

19 Claims, 5 Drawing Figures

TENNIS PRACTICE AID

BACKGROUND OF THE INVENTION

1. Technical Field

This invention relates generally to tennis equipment, and particularly to a net-mountable guide with which to improve aim.

2. Background Information

Speed, strength, and agility are important in tennis. But skillful ball placement provides a significant competitive edge that is often more readily attained, and many practice aids and coaching theories strive to develop this skill.

The notable technique of visualizing a target along the tennis net is particularly effective. Rather than aiming directly at the far court where the ball is to be placed, attention is directed to a spot along the net, and the ball hit over the net at the selected spot. Guided in this manner, more consistent ball placement results.

For practice purposes, some type of target or guide along the net is needed. U.S. Pat. No. 4,231,572 to Thornton and U.S. Pat. No. 3,993,306 to Scott describe two target structures for use above an installed tennis net, but these suffer from certain drawbacks. The device described in the Thornton patent is a large, spring loaded, rectangular frame with posts that must be interwoven with the netting, while the device described in the Scott patent employs a strip that must be specially installed across the court above the net.

Thus, these devices are often cumbersome and inconvenient to use. Consequently, it is desirable to have a new and improved device for mounting on an installed tennis net as a guide for practice purposes.

SUMMARY OF THE INVENTION

Therefore, the principal object of the present invention is to provide a new and improved net-mountable guide for tennis practice purposes.

It is an object to provide such a device that is adapted to be secured to just the headband of a conventional tennis net.

And it is a further object to provide such a device with an appearance that does not significantly alter the appearance of the net, while being inexpensive to manufacture, easy to transport, and convenient to install.

Briefly, the above and further objects of the invention are realized by providing a new and improved tennis practice aid for mounting on the headband of an installed tennis net that employs a target member defining a silhouette having a size generally on the order of a conventional tennis ball.

A mounting member adapted to be removably secured to a conventional tennis net headband by engagement of just the headband serves as a mounting for the target member. The target member is connected to the mounting member so that the target member is supported slightly above a headband to which the mounting member is secured.

The mounting member in one form of the invention includes an upper edge portion adapted to engage the top edge of a conventional tennis net headband, and a lower edge portion adapted to fit through a conventional net opening and engage the bottom edge of the headband.

A low profile version of the invention is also disclosed in which a separate target member is omitted, the mounting member providing the target.

Thus, a novel combination of elements is provided to produce a superior tennis practice aid of uncomplicated design that is far less expensive to manufacture. The device is easily transported to the courts and conveniently installed at a selected location along the tennis net headband where it engages just the headband to provide a lightweight, unobtrusive guide for tennis training purposes.

In addition to the above mentioned features, the unitary flexible composition of one form of the invention achieves superior resistance to user abuse.

BRIEF DESCRIPTION OF THE DRAWINGS

These, and other objects and features of this invention and the manner of attaining them will become apparent, and the invention itself will be best understood, by reference to the following description of an embodiment of the invention taken in conjunction with the accompanying drawings.

DESCRIPTION OF THE PREFERRED EMBODIMENTS

Figure 1:
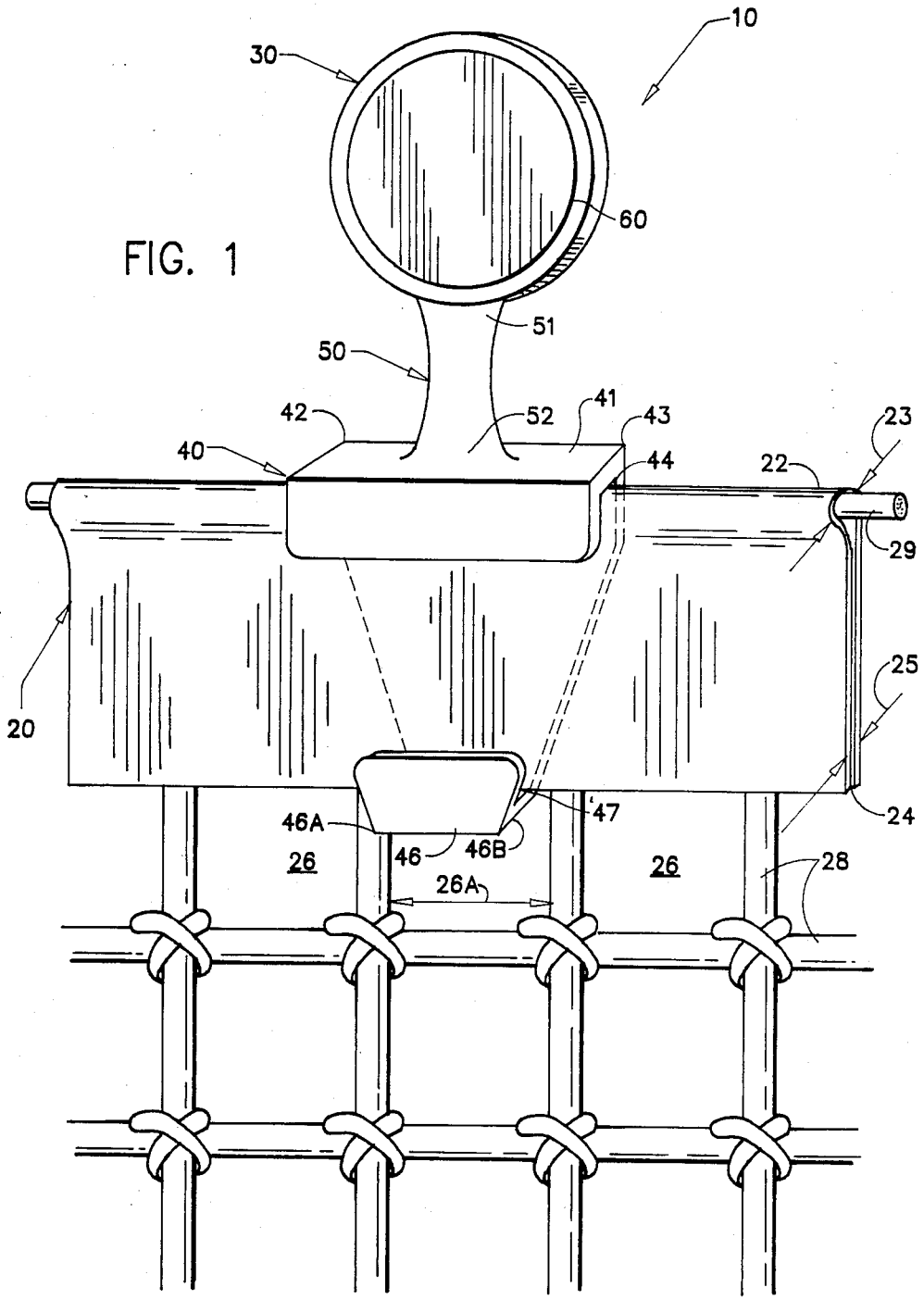
FIG. 1 of the drawings is a perspective view of a device constructed according to the invention mounted on an installed tennis net.
Figure 2:
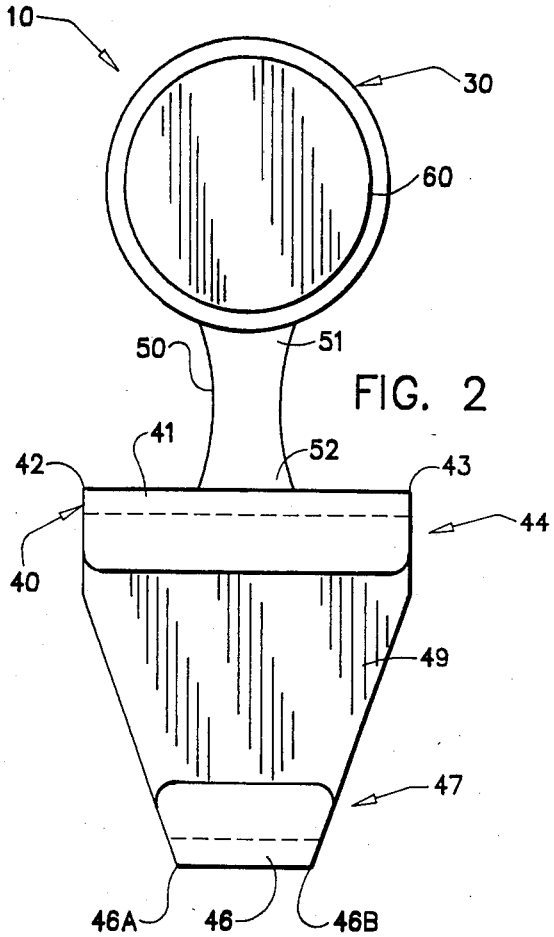
FIG. 2 is a front elevation view of the device.
Figure 3:
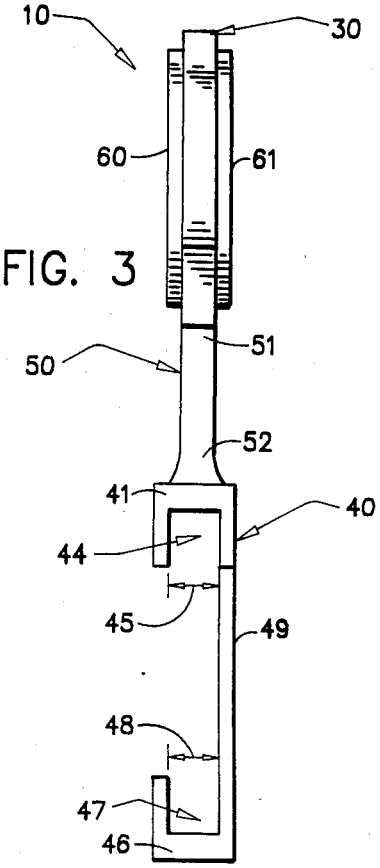
FIG. 3 is a side elevation view.

FIGS. 1–3 of the drawing illustrate a device 10 constructed in accordance with the invention. Device 10 is shown in FIG. 1 mounted on just the headband 20 of a conventional tennis net, between the top edge 22 and bottom edge 24 of the headband. Mounted in this manner, the device 10 extends through one of the net openings 26 defined by netting 28, and it is supported in this position, along with the headband and netting, by cable 29.

The device 10 is an article of unitary construction adapted to be removably secured to and extend above a conventional tennis net headband. In this position it provides a silhouette that serves as a guide by which to aim when hitting a tennis ball. It is composed of a suitable generally rigid material, such as one-eighth inch thick thermoplastic material, injection molded to the desired configuration according to known techniques. Other materials and fabrication techniques may be employed.

The device 10 includes a generally disc-shaped target portion 30 defining a silhouette having a size generally on the order of the size of a conventional tennis ball (FIGS. 1–3). As used herein, this means that the target portion 30 has a cross sectional area of a size generally lying in a range defined by the cross sectional area of a conventional golf ball and the area of the face of a conventional tennis racket head (a maximum of approximately 12½ inches wide). Various other shapes may be employed within this size range.

This size presents a sufficiently large target area for many users, without detracting from the appearance of the net and introducing additional weight to the device. With the device mounted on the headband, the silhouette thus presented is disposed slightly above the headband in a position such that a face of the target member is generally coplanar with the net.

The device 10 also includes mounting portion 40 adapted to be removably secured to a conventional tennis net headband to mount the device on the headband. The mounting portion 40 is adapted to be secured to just the headband, without engaging the netting. Thus, it is conveniently installed, without extra effort and without detracting from tennis net appearance.

In addition, the device 10 includes an extension portion 50 extending from the mounting portion 40 to the tarqet portion 30. The extension portion 50 connects the target portion to the mounting portion. It has a target end 51 at target portion 30, and a headband end 52 at mounting portion 40, with a length between the target end and headband end sufficient to position the target portion slightly above a headband to which the mounting portion is secured.

The mounting portion 40 of the illustrated embodiment includes an upper edge portion 41 extending between edge 42 and edge 43. The upper edge portion 41 defines an upper channel 44 having a generally inverted U shape that extends between edges 42 and 43 for engaging the top edge 22 of the headband 20 by placement over the top edge. It is inverted in the sense that the two legs of the "U" extend downwardly on opposite sides of the headband when the device is placed in operating position on the headband.

The upper channel 44 has a channel width at 45 (FIG. 3) slightly larger than the thickness of the top edge 22 that is designated in FIG. 1 by the arrows at 23. A conventional tennis net headband is on the order of less than $\frac{3}{8}$ inch thick at this point, the cable within having a maximum $\frac{1}{3}$ inch diameter.

The mounting portion 40 also includes a lower edge portion 46 extending between edge 46A and edge 46B. The lower edge portion 46 has a length between edges 46A and 46B generally no larger than the width of net openings 26 at numeral 26A (FIG. 1). A conventional tennis net employs a sufficiently small mesh to prevent the tennis ball ($2\frac{1}{2}''$ to $2\frac{5}{8}''$ diameter) passing through, net openings approximately 1 to $1\frac{1}{2}$ inches wide being typical. Thus, a corresponding one inch length between edge 46A and edge 46B is employed in the illustrated embodiment.

The lower edge portion 46 defines a lower channel 47 extending between edges 46A and 46B that is generally parallel to the upper channel 44. The lower channel 47 has a generally upright U shape for engaging the bottom edge 24 of the headband 20 by placement over the bottom edge, the legs of the "U" extending upwardly when the device is secured in an operating position on the headband.

The lower channel 47 has a channel width at 48 in FIG. 3 that is slightly larger than the thickness of the bottom edge 24 of headband 20 at the arrows at 25 in FIG. 1. A conventional tennis net headband is on the order of less than $\frac{3}{8}$ inch thick at this point also, so that upper and lower channels of equal width are employed in the illustrated embodiment for a degree of symmetry.

The interconnecting portion 49 of the mounting portion 40 extends from the upper edge portion 41 to the lower edge portion 46. The interconnecting portion has a height between the upper and lower edge portions such that the upper and lower channels are separated by a distance on the general order of the width between the top and bottom edges of a conventional tennis net headband, approximately 2 to $2\frac{1}{2}$ inches.

This permits placement of the upper and lower channels over respective ones of the top and bottom edges of the headband, to removably secure the mounting portion to the headband with the target portion disposed slightly above the headband. The top and bottom edges of the headband are squeezed together slightly to mount the device, and then released.

In order to enhance user discernment of the device 10, high-visibility decals 60 and 61 are provided (FIGS. 1–3). These may be any of various colors and designs that make the position of the device along the headband easily seen, including those colors commonly termed "high-visibility."

Although the illustrated device 10 is of unitary construction, it is within the inventive concepts herein to construct the device of this invention from separate components. Such a device can employ a target member, mounting member, and extension member, similar to the target portion 30, mounting portion 40, and extension portion 50 of the device 10, and these members are attached together to form a device similar to device 10.

Figure 4:
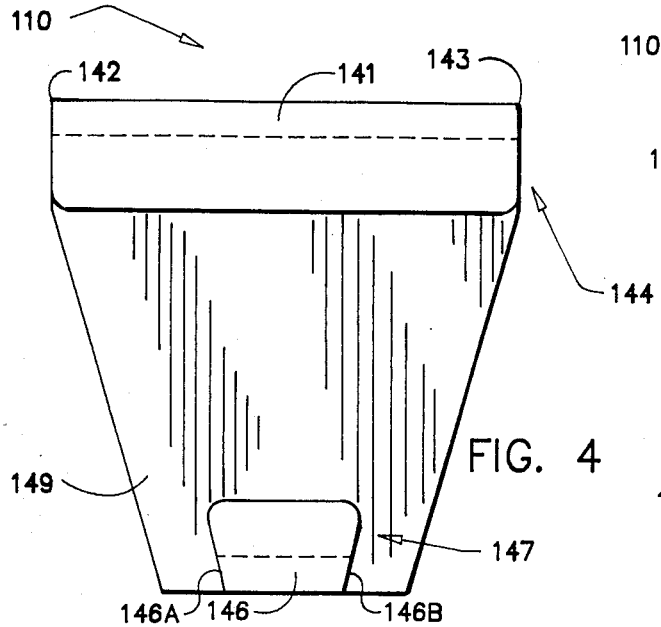
FIG. 4 is a front elevation view of a low profile version of the invention having no extension or target member.
Figure 5:
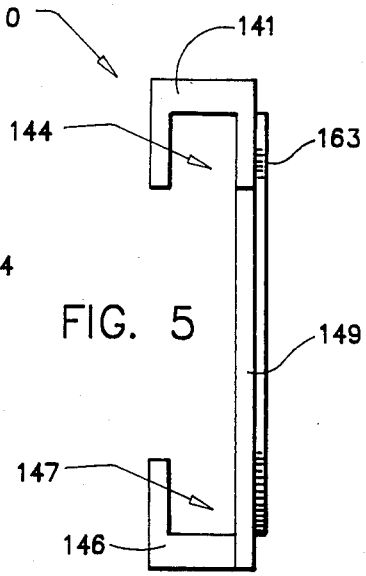
FIG. 5 is a side elevation view of the low profile version.

The low profile version illustrated in FIGS. 4 and 5 also falls within these inventive concepts. The low profile version is designated generally by reference numeral 110, and shown to include a mounting member 140 that does not include an extension or target member. The illustrated mounting member 140 is slightly wider between edge 142 and edge 143 (approximately 3" to 4" in the embodiment of FIG. 4) than the mounting portion 40 of the device 10 between edge 42 and edge 42 (approximately $2\frac{1}{2}''$ to 3" in the embodiment of FIG. 1). It is otherwise similar to the device 10, however, and will not be described in detail. For convenience, reference numerals in FIGS. 4 and 5 are increased by 100 over reference numerals designating similar features of device 10 in FIGS. 1–3.

Without an extension and target member, similar to extension portion 50 and target portion 30 of device 10, the alternate device 110 maintains a low profile on the net. The interconnecting portion 149 serves as the target, lying along the headband to highlight a selected section. The greater width of the upper edge portion 141 and interconnecting portion 149 provides more surface area to be seen. The width may be more or less, however, within the inventive concepts herein disclosed.

The illustrated device 110 is composed of a thermoplastic material having a light color that blends in with the white color of a conventional headband. Other suitable material may be employed.

The device 110 employs a high-visibility component also, tape 163, which is adhesively secured to the interconnecting portion 149. This combination of low profile and tape 163 enhances user discernment of the device 110 when viewed from the side of the net that the interconnecting member faces, while providing a relatively unnoticeable appearance on the other side of the net.

Yet another form of the invention that is similar to the device 110, employs a colored thermoplastic material, instead of the tape 163. This achieves a simple device that is very inexpensive to manufacture.

And, instead of the mounting member described, a spring-loaded clip member can be employed to grip just the headband.

Thus, this invention in its various forms provides an easily manufactured, conveniently-installed, and handy-to-use tennis practice aid for use as a guide during practice.

As various changes may be made in the form, construction, and arrangement of the procedures and parts described herein, without departing from the spirit and scope of the invention and without sacrificing any of its advantages, all matter herein is to be interpreted as illustrative and not in any limiting sense.

What is claimed is:

1. A device for mounting on an installed tennis net for practice purposes, comprising:

a target member defining a silhouette having a size generally on the order of the size of a conventional tennis ball;

a mounting member adapted to be removably secured to a conventional tennis net headband by engagement of just the headband;

connecting means for connecting the target member to the mounting member so that the target member is supported slightly above a headband to which the mounting member is secured;

an upper edge portion of the mounting member adapted to engage the top edge of a conventional tennis net headband, the upper edge portion defining an upper channel having a generally inverted U-shape for placement over the top edge of a headband, the upper channel having a width slightly larger than the thickness of the top edge of a conventional tennis net headband;

a lower edge portion of the mounting member adapted to engage the bottom edge of a convention tennis net headband, the lower edge portion having a length generally no larger than the width of a conventional net opening, the lower edge portion defining a lower channel generally parallel to the upper channel having a generally upright U-shape for placement over the bottom edge of a headband, the lower channel having a channel width slightly larger than the thickness of the bottom edge of a conventional tennis net headband; and an interconnecting portion of the mounting member extending from the upper edge portion to the lower edge portion, the interconnecting portion having a height between the upper and lower edge portions such that the upper and lower channels are separated by a distance on the general order of the width of a conventional tennis net headband, to enable placement of the upper and lower channels over respective ones of the top and bottom edges of a headband and removably secure the device to the headband with the target member disposed slightly above the headband.

2. A device as recited in claim 1, wherein:

the connecting means comprises an extension member having a target end portion attached to the target member and a headband end portion attached to the mounting member.

3. A device as recited in claim 2, wherein:

the extension member is composed of a flexible material enabling the target member to yield to a tennis ball striking the target member.

4. A device as recited in claim 1, further comprising:

decal means for defining a high-visibility decal member attached to a face of the target member for enhancing user discernment of the target portion.

5. A device as recited in claim 1, wherein:

the device is of unitary construction.

6. A device as recited in claim 5, wherein:

the device is composed of a flexible material.

7. A device as recited in claim 1, wherein:

the mounting member has a generally C-shaped cross section defining a pair of parallel, space-apart, upper and lower channels adapted to engage respective ones of the top and bottom edges of a conventional tennis net headband.

8. A device as recited in claim 1, wherein:

the mounting member has an upper edge portion adapted to engage the top edge of a conventional tennis net headband, and a lower edge portion adapted to fit through a conventional net opening and engage the bottom edge of the headband.

9. A device for mounting on an installed tennis net for practice purposes, comprising:

a generally disc-shaped target member defining a silhouette having a size generally on the order of the size of a conventional tennis ball;

a mounting member adapted to be removably secured to the top and bottom edges of a conventional tennis net headband as a mounting for the target member;

an extension member having a target end portion attached to the target member and a headband end portion attached to the mounting member, to support the target member slightly above and in general coplanar relation with a headband to which the mounting member is secured;

an upper edge portion of the mounting member, the upper edge portion defining an upper channel having a generally inverted U shape for placement over the top edge of a headband, the upper channel having a width slightly larger than the thickness of the top edge of a conventional tennis net headband;

a lower edge portion of the mounting member having a length generally no larger than the width of a conventional net opening, the lower edge portion defining a lower channel generally parallel to the upper channel having a generally upright U shape for placement over the bottom edge of a headband, the lower channel having a channel width slightly larger than the thickness of the bottom edge of a conventional tennis net headband; and an interconnecting portion of the mounting member extending from the upper edge portion to the lower edge portion, the interconnecting portion having a height between the upper and lower edge portions such that the upper and lower channels are separated by a distance on the general order of the width between the top and bottom edges of a conventional tennis net headband, to enable placement of the upper and lower channels over respective ones of the top and bottom edges of a headband and removably secure the device to the headband with the target member disposed slightly above the headband.

10. A device as recited in claim 9, further comprising:

decal means for defining a high-visibility decal member attached to a face of the target member for enhancing user discernment of the target portion.

11. A device as recited in claim 9, wherein:

the extension member is composed of a flexible material enabling the target member to yield to a tennis ball striking the target member.

12. A device as recited in claim 9, wherein:

the device is of unitary construction.

13. A device as recited in claim 12, wherein:

the device is composed of a flexible material.

14. A device as recited in claim 9, wherein:

the mounting member has an upper channel length generally no longer than sufficient to span three adjacent conventional tennis net openings, and a height slightly more than the distance between the top and bottom edges of a conventional tennis net headband.

15. A device as recited in claim 9, wherein:

the interconnecting member includes a generally flat plate extending between the upper edge portion and the lower edge portion.

16. A device for mounting on an installed tennis net for practice purposes, comprising:

an article of unitary construction adapted to be removably secured to and extend above a conventional tennis net headband, to provide a silhouette for guide purposes;

a generally disc-shaped target portion of the article defining a silhouette having a size generally on the order of the size of a conventional tennis ball;

a mounting portion of the article adapted to be removably secured to the top and bottom edges of a conventional tennis net headband to mount the article on the headband;

an extension portion of the article extending from the mounting portion to the target portion, the extension portion having a length between the mounting portion and the target portion sufficient to position the target portion slightly above and in general coplanar relation with a headband to which the mounting portion is secured;

an upper edge portion of the mounting portion, the upper edge portion defining an upper channel having a generally inverted U-shape for placement over the top edge of a headband, the upper channel having a width slightly larger than the thickness of the top edge of the headband;

a lower edge portion of the mounting portion having a length generally no larger than the width of a conventional net opening, the lower edge portion defining a lower channel generally parallel to the upper channel, the lower edge portion having a generally upright U shape for placement over the bottom edge of a headband, the lower channel having a width slightly larger than the thickness of the bottom edge of a conventional tennis net headband; and a interconnecting portion of the mounting portion extending from the upper edge portion to the lower edge portion, the interconnecting portion having a height between the upper and lower edge portions suoh that the upper and lower channels are separated by a distance on the general order of the width between the top and bottom edges of a conventional tennis net headband, to enable placement of the upper and lower channels over respective ones of the top and bottom edges of the headband and removably secure the mounting portion to the headband with the target portion disposed slightly above the headband.

17. A device as recited in claim 16, further comprising:

decal means defining a high-visibility decal member attached to a face of the target member for enhancing user discernment of the target portion.

18. A device as recited in claim 16, wherein:

the article is composed of a flexible material enabling the target portion to yield to a tennis ball striking the target portion.

19. A device as recited in claim 16, the mounting portion has an upper channel length generally no longer than sufficient to span three adjacent conventional tennis net openings, and a height slightly more than the distance between the top and bottom edges of a conventional tennis net headband.

* * * * *